US011885545B2

(12) United States Patent
Tisserand et al.

(10) Patent No.: US 11,885,545 B2
(45) Date of Patent: Jan. 30, 2024

(54) DYNAMIC LIQUID RECEIVER AND CONTROL STRATEGY

(71) Applicant: TRANE INTERNATIONAL INC., Davidson, NC (US)

(72) Inventors: Philippe Del Marcel Tisserand, Eloyes (FR); Stephane David Koenigsecker, Charmes (FR); Yves Jacques Raimbault, Uxegney (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/818,172

(22) Filed: Aug. 8, 2022

(65) Prior Publication Data

US 2022/0381495 A1 Dec. 1, 2022

Related U.S. Application Data

(63) Continuation of application No. 17/362,558, filed on Jun. 29, 2021, now Pat. No. 11,408,657.

(30) Foreign Application Priority Data

Jun. 30, 2020 (EP) ..... 20183239

(51) Int. Cl.
*F25B 45/00* (2006.01)
*F25B 49/02* (2006.01)
(Continued)

(52) U.S. Cl.
CPC ..... *F25B 49/02* (2013.01); *F25B 40/02* (2013.01); *F25B 41/20* (2021.01); *F25B 43/006* (2013.01);
(Continued)

(58) Field of Classification Search
CPC ..... F25B 40/02; F25B 41/20; F25B 45/00; F25B 49/02; F25B 2345/0003;
(Continued)

(56) References Cited

U.S. PATENT DOCUMENTS 4,196,595 A 4/1980 Shaw
5,070,705 A 12/1991 Goodson et al.
(Continued)

FOREIGN PATENT DOCUMENTS

WO 2014/035134 A1 3/2014
WO WO-2015043678 A1 * 4/2015 ..... F25B 47/022
(Continued)

OTHER PUBLICATIONS

Laughman et al., "Dynamic Charge Management for Vapor Compression Cycles", International Refrigeration and Air Conditioning Conference. Paper 1799., 11 pages (2016).
(Continued)

*Primary Examiner* — Jonathan Bradford
(74) *Attorney, Agent, or Firm* — Hamre, Schumann, Mueller & Larson, P.C.

(57) ABSTRACT

A dynamic receiver is included in parallel to an expander of a heating, ventilation, air conditioning, and refrigeration (HVACR) system. The dynamic receiver allows control of the refrigerant charge of the HVACR system to respond to different operating conditions. The dynamic receiver can be filled or emptied in response to the subcooling observed in the HVACR system compared to desired subcooling for various operating modes. The HVACR system can include a line directly conveying working fluid from compressor discharge to the dynamic receiver to allow emptying of the dynamic receiver to be assisted by injection of the compressor discharge.

11 Claims, 4 Drawing Sheets

(51) Int. Cl.
*F25B 41/20* (2021.01)
*F25B 40/02* (2006.01)
*F25B 43/00* (2006.01)

(52) U.S. Cl.
CPC ..... *F25B 45/00* (2013.01); *F25B 2345/003* (2013.01); *F25B 2345/006* (2013.01); *F25B 2400/161* (2013.01); *F25B 2400/19* (2013.01); *F25B 2500/23* (2013.01); *F25B 2500/24* (2013.01); *F25B 2600/2523* (2013.01); *F25B 2700/19* (2013.01); *F25B 2700/21* (2013.01)

(58) Field of Classification Search
CPC ..... F25B 2345/006; F25B 2400/161; F25B 2600/2523; F25B 2700/19; F25B 2700/21
See application file for complete search history.

(56) References Cited

U.S. PATENT DOCUMENTS

| | | | |
|---|---|---|---|
| 5,359,863 | A | 11/1994 | Lewis et al. |
| 8,056,348 | B2 | 11/2011 | Murakami et al. |
| 8,100,167 | B2 | 1/2012 | Thybo et al. |
| 8,783,050 | B2 | 7/2014 | Okamoto et al. |
| 9,803,902 | B2 | 10/2017 | Pham |
| 9,874,384 | B2 | 1/2018 | Connell et al. |
| 10,302,342 | B2 | 5/2019 | Vaisman |
| 10,551,101 | B2 | 2/2020 | Takeichi et al. |
| 2008/0011004 | A1 | 1/2008 | Lesage et al. |
| 2008/0190130 | A1 | 8/2008 | Murakami et al. |
| 2011/0041523 | A1 | 2/2011 | Taras et al. |
| 2017/0115043 | A1 | 4/2017 | Laughman et al. |
| 2019/0376731 | A1 | 12/2019 | Iwata et al. |
| 2022/0034565 | A1 | 2/2022 | Weng et al. |

FOREIGN PATENT DOCUMENTS

| | | | | |
|---|---|---|---|---|
| WO | 2018/135850 | A1 | 7/2018 | |
| WO | WO-2018135850 | A1 * | 7/2018 | ..... F24F 11/83 |

OTHER PUBLICATIONS

Extended European Search Report, European Patent Application No. 20183239.1, dated Dec. 7, 2020 (7 pages).
Extended European Search Report; European Patent Application No. 23175483.9, dated Oct. 18, 2023 (8 pages).

* cited by examiner

DYNAMIC LIQUID RECEIVER AND CONTROL STRATEGY

FIELD

This disclosure is directed to a dynamic liquid receiver in a refrigeration circuit and control strategies for dynamic liquid receivers.

BACKGROUND

Refrigeration circuits typically include liquid receivers that have fixed filling processes. The refrigerant charge in the receiver is thus maintained at a fixed level. Receiver filling has different effects on efficiency at different loads and at different parts of the operating map. A fixed receiver filling setting has to sacrifice local improvements to efficiency under some operating conditions in order to be set to a value providing adequate efficiency across different parts of the operating map.

SUMMARY

This disclosure is directed to a dynamic liquid receiver in a refrigeration circuit and control strategies for dynamic liquid receivers.

By controlling the amount of refrigerant charge in a system dynamically, more efficient operating conditions can be selected for both full-load and part-load conditions and the operating map for the refrigeration system can be increased.

In an embodiment, a heating, ventilation, air conditioning, and refrigeration (HVACR) system includes a compressor, a first heat exchanger, an expander, a second heat exchanger, and a dynamic receiver in a fluid circuit. The dynamic receiver is in parallel with the expander with respect to the fluid circuit. The HVACR system further includes a fluid line configured to convey discharge from the compressor to the dynamic receiver.

In an embodiment, the HVACR system further includes a four-way valve.

In an embodiment, the HVACR system further includes a third heat exchanger. The first heat exchanger is configured to exchange heat between a working fluid in the fluid circuit and a first process fluid, the second heat exchanger is configured to exchange heat between the working fluid and a second process fluid, and the third heat exchanger is configured to exchange heat with ambient air.

In an embodiment, the HVACR system further includes a controller configured to operate an inlet valve positioned directly upstream of the dynamic receiver, an outlet valve positioned directly downstream of the dynamic receiver, and a compressor discharge injection valve positioned along the fluid line to regulate a quantity of a working fluid stored in the dynamic receiver. In an embodiment, the controller is configured to determine a target quantity of working fluid to be stored in the dynamic receiver based on a measured liquid line subcooling value and a subcooling threshold value. In an embodiment, the measured liquid line subcooling value is based on a liquid line temperature measurement and a liquid line pressure measurement. In an embodiment, the target quantity of working fluid is further based on a $K_P$ value. In an embodiment, the controller is configured to reduce the quantity of working fluid stored in the dynamic receiver by opening the outlet valve and the compressor discharge injection valve until the target quantity of working fluid is stored in the dynamic receiver. In an embodiment, the controller is configured to increase the quantity of working fluid stored in the dynamic receiver by opening the inlet valve until a target quantity of working fluid is stored in the dynamic receiver. In an embodiment, the subcooling threshold value is based on an operating mode of the HVACR system.

A method of controlling a heating, ventilation, air conditioning, and refrigeration (HVACR) system according to an embodiment includes determining, using a controller, a target quantity of working fluid to be stored in a dynamic receiver included in the HVACR system, the target quantity based on a subcooling threshold value and a measured subcooling value. The method further includes comparing a quantity of working fluid in the dynamic receiver to the target quantity. When the quantity of working fluid in the dynamic receiver exceeds the target quantity, working fluid is removed from the dynamic receiver by opening an outlet valve directly downstream of the dynamic receiver and opening a compressor discharge injection valve disposed along a fluid line connecting the discharge of a compressor of the HVACR system to the dynamic receiver. When the quantity of working fluid in the dynamic receiver is less than the target quantity, working fluid is added to the dynamic receiver by opening an inlet valve directly upstream of the dynamic receiver with respect to the working fluid flow path in the HVACR system. The dynamic receiver is in parallel with an expander included in the HVACR system.

In an embodiment, the measured liquid line subcooling value is based on a liquid line temperature measurement and a liquid line pressure measurement. In an embodiment, the target quantity of working fluid is further based on a $K_P$ value. In an embodiment, the subcooling threshold value is based on an operating mode of the HVACR system.

DRAWINGS

DETAILED DESCRIPTION

This disclosure is directed to a dynamic liquid receiver in a refrigeration circuit and control strategies for dynamic liquid receivers.

Figure 1A:
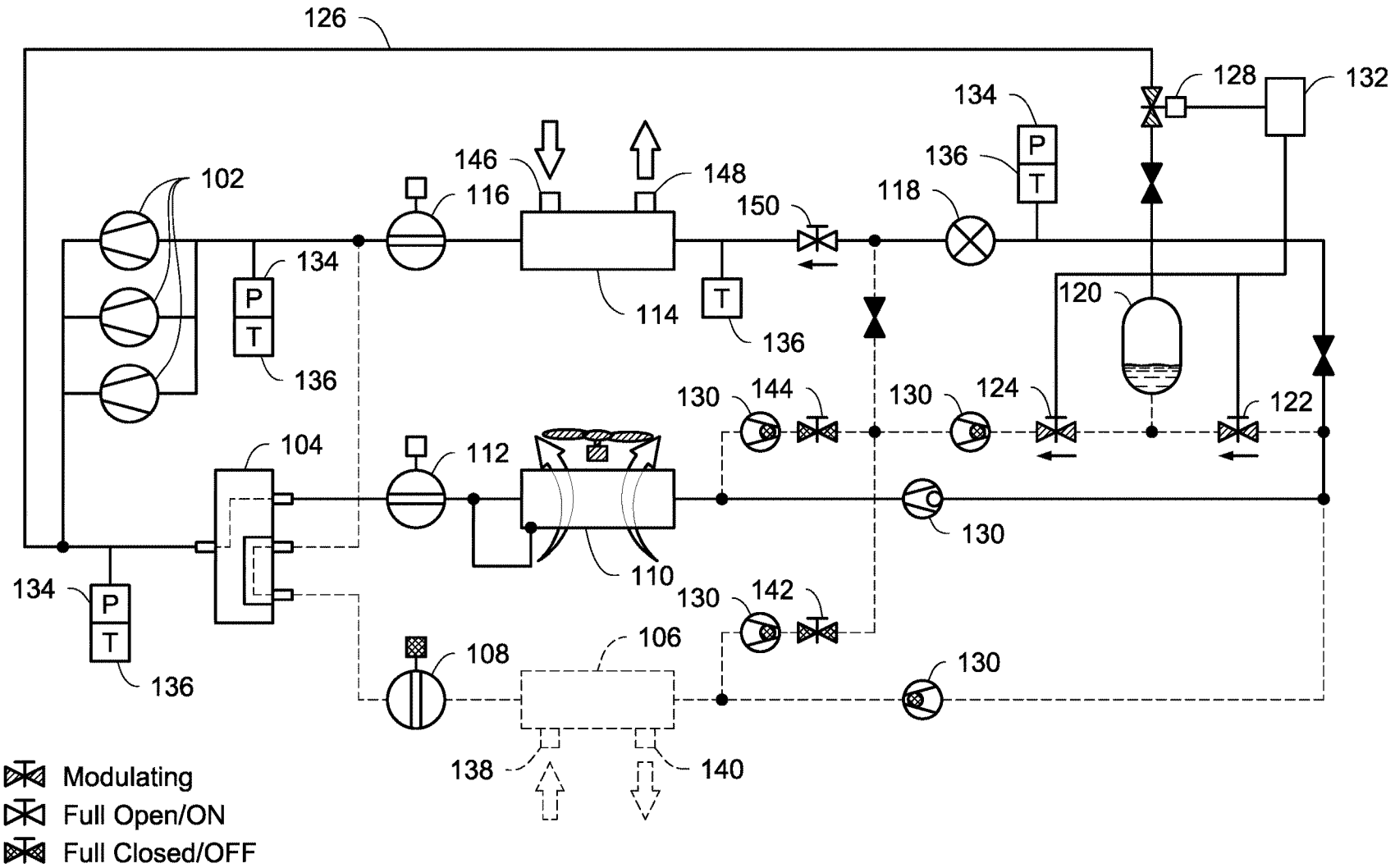
FIG. 1A shows a schematic of a heating, ventilation, air conditioning, and refrigeration (HVACR) system according to an embodiment operating in a cooling mode.

FIG. 1A shows a schematic of a heating, ventilation, air conditioning, and refrigeration (HVACR) system according to an embodiment operating in a cooling mode. HVACR system 100 includes one or more compressors 102 and a four-way valve 104. HVACR system 100 further includes a first heat exchanger 106, with a first heat exchanger isolation valve 108 between the four-way valve 104 and the first heat exchanger 106, a second heat exchanger 110, with a second heat exchanger isolation valve 112 between the four-way valve 104 and the second heat exchanger 110, and a third heat exchanger 114, with a third heat exchanger isolation valve 116. The HVACR system 100 further includes an expander 118 and a dynamic receiver 120. Inlet valve 122 is upstream of dynamic receiver 120, and outlet valve 124 is downstream of dynamic receiver 120 with respect to the direction of flow of working fluid through HVACR system 100. A compressor discharge injection line 126 runs from the discharge of the one or more compressors 102 directly to the dynamic receiver 120, with a compressor discharge injection valve 128 disposed along the compressor discharge injection line 126. Check valves 130 are included along various fluid lines to permit only one direction of flow through those particular lines. A controller 132 controls at least the inlet valve 122, outlet valve 124, and compressor discharge injection valve 128. Controller 132 can receive data from one or more pressure sensors 134 and/or temperature sensors 136 measuring the conditions of the working fluid at points in HVACR system 100.

HVACR system 100 is an HVACR system for providing climate control to at least one conditioned space. In the embodiment shown in FIG. 1A, the HVACR system is a four-pipe HVACR system, including separate heating and cooling lines to the appropriate respective heat exchangers so that one or both of heating and cooling can be provided simultaneously.

One or more compressors 102 are provided. The compressors 102 can be any one or more suitable compressors for compressing a working fluid, such as screw compressors, scroll compressors, or the like. Where multiple compressors 102 are included in HVACR system 100, the compressors can be in parallel with one another. The one or more compressors 102 discharge compressed working fluid into a discharge line conveying the discharge towards four-way valve 104. In an embodiment, the one or more compressors 102 can be one to four compressors.

Four-way valve 104 is configured to selectively control fluid communication between the discharge of the one or more compressors 102 and one of the second heat exchanger 110 and third heat exchanger 114. Four-way valve 104 is further configured to selectively control communication of the other of the second heat exchanger 110 and third heat exchanger 114 and the suction of the one or more compressors 102. Four-way valve can be any suitable valve or arrangement of valves to provide the selectively controllable fluid communication described above.

First heat exchanger 106 is a heat exchanger configured to receive a working fluid and exchange heat between the working fluid and a heating process fluid used to provide heating. First heat exchanger 106 can be any suitable type of heat exchanger for providing the heat exchange between the working fluid and the heating process fluid. The heating process fluid can be any suitable process fluid for providing heating, such as water. The heating process fluid can be received from a heating process fluid inlet line 138, and in modes providing heating such as those shown in FIGS. 1B and 1C, discharged at a relatively higher temperature from the heating process fluid outlet line 140.

First heat exchanger isolation valve 108 is a valve located between the four-way valve 104 and the first heat exchanger 106. First heat exchanger isolation valve 108 can be any suitable valve having an open position permitting flow therethrough and a closed position prohibiting flow therethrough. First heat exchanger isolation valve 108 can be selectively controlled based on an operating mode of the HVACR system 100, for example, being closed in the cooling mode shown in FIG. 1A. It is understood that valves such as first heat exchanger isolation valve 108 or any of the other valves described herein may allow small amounts of leakage in the closed position, for example due to wear, manufacturing tolerances or defects, and the like, and that the closed position of the valve is still understood as prohibiting flow even if such leakage may occur.

In an embodiment, a defrost valve 142 can be located along a fluid line providing communication between expander 118 and the first heat exchanger 106. Defrost valve 142 can be a controllable valve having at least a closed position prohibiting flow therethrough and an open position allowing flow. The defrost valve 142 can be placed into an open position to perform a defrost operation, and closed in other operating modes of the HVACR system 100 such as the cooling only, heating only, and heating and cooling modes shown in FIGS. 1A-1C, respectively.

Second heat exchanger 110 is a heat exchanger configured to receive a working fluid and exchange heat between the working fluid and a heat exchange medium other than the heating process fluid or the cooling process fluid heated or cooled, respectively, by HVACR system 100. The heat exchange medium can be, for example, an ambient environment. Second heat exchanger 110 can be any suitable type of heat exchanger for providing the heat exchanger between the working fluid and ambient environment. In an embodiment, ambient environment can accept heat rejected at the second heat exchanger 110 in a cooling mode such as that shown in FIG. 1A, with second heat exchanger 110 serving as a condenser to condense the discharge from the one or more compressors 102. In an embodiment, the working fluid can absorb heat from the ambient environment at second heat exchanger 110, for example in the heating mode shown in FIG. 1B, where the second heat exchanger 110 serves as an evaporator for working fluid received from expander 118.

Second heat exchanger isolation valve 112 is located between the four-way valve 104 and the second heat exchanger 110. Second heat exchanger isolation valve 112 can be any suitable valve having an open position permitting flow therethrough and a closed position prohibiting flow therethrough. Second heat exchanger isolation valve 112 can be selectively controlled based on an operating mode of the HVACR system 100, for example, being closed in the heating and cooling mode shown in FIG. 1C.

In an embodiment, a heat pump valve 144 is located along a fluid line providing fluid communication between expander 118 and second heat exchanger 110. Heat pump valve 144 is a controllable valve having at least an open position allowing flow and a closed position prohibiting flow from expander 118 to second heat exchanger 110. Heat pump valve 144 can be in the open position, for example, during a heating operation such as the heating operation of HVACR system 100 shown in FIG. 1B. Heat pump valve 144 can be closed in at least some other operating modes, such as the cooling operating mode shown in FIG. 1A and the heating and cooling operating mode shown in FIG. 1C.

Third heat exchanger 114 is a heat exchanger configured to receive a working fluid and exchange heat between the working fluid and a cooling process fluid used to provide cooling. Third heat exchanger 114 can be any suitable type of heat exchanger for providing the heat exchanger between the working fluid and the cooling process fluid. The cooling process fluid can be any suitable process fluid for providing cooling, such as water, combinations of water with ethylene glycol, or the like. The cooling process fluid can be received from a cooling process fluid inlet line 146, and in modes providing cooling such as those shown in FIGS. 1A and 1C, discharged at a relatively lower temperature from the cooling process fluid outlet line 148. Third heat exchanger 114 operates as an evaporator, evaporating working fluid received from expander 118 by absorbing heat from the cooling process fluid.

Third heat exchanger isolation valve 116 is a valve located between the four-way valve 104 and/or the suction of the one or more compressors 102 and the third heat exchanger 114. Third heat exchanger isolation valve 116 can be any suitable valve having an open position permitting flow therethrough and a closed position prohibiting flow therethrough. Third heat exchanger isolation valve 116 can be selectively controlled based on an operating mode of the HVACR system 100, for example, being closed in the heating mode shown in FIG. 1B and open in the cooling and heating and cooling modes shown in FIGS. 1A and 1C, respectively.

Cooling valve 150 is located along the fluid line from expander 118 to third heat exchanger 114. Cooling valve 150 is a controllable valve having at least an open position allowing flow and a closed position prohibiting flow from expander 118 to third heat exchanger 114. Cooling valve 150 can be in the open position, for example, during a cooling operation such as the cooling operation of HVACR system 100 shown in FIG. 1A or the heating and cooling operation shown in FIG. 1C. Cooling valve 150 can be closed in at least some other operating modes, such as the heating operating mode shown in FIG. 1B.

Expander 118 is configured to expand working fluid received from one of the first heat exchanger 106 or second heat exchanger 110. Expander 118 can be any suitable expander for the working fluid, such as an expansion valve, an expansion plate, an expansion vessel, one or more expansion orifices, or any other known suitable structure for expanding the working fluid.

Dynamic receiver 120 is a liquid received configured to store working fluid. Dynamic receiver 120 can be any suitable receiver for storing the working fluid, such as but not limited to a reservoir, vessel, container, tank or other suitable volume. Dynamic receiver 120 can store the working fluid as a liquid. Working fluid stored in dynamic receiver 120 is removed from circulation through the remainder of HVACR system 100 while it is stored, allowing the quantity of working fluid circulating in HVACR system 100 to be controlled by changing the quantity of working fluid stored in dynamic receiver 120. The amount of working fluid in dynamic receiver 120 can be controlled to respond to operating modes and/or operating conditions, for example by controller 132 controlling inlet valve 122, outlet valve 124, and compressor discharge injection valve 128, or controlled according to the method shown in FIG. 2 and described below. The dynamic receiver 120 can be sized such that it can accommodate sufficient liquid working fluid to cover a difference in charge between any or all of the operating modes of the HVACR system 100. The sizing of the dynamic receiver 120 may be such that the amount of working fluid that can be stored further accounts for transitions between those operating modes or other operating conditions. For example, in the embodiment shown in FIGS. 1A-1C, the dynamic receiver 120 can be sized such that it can accommodate up to approximately 60% of the maximum charge of working fluid for the HVACR system 100. In an embodiment, the dynamic receiver 120 can be sized such that it can accommodate up to approximately 40% of the maximum charge of working fluid for the HVACR system 100. The level shown in dynamic receiver 120 in FIG. 1A shows one potential approximate quantity of working fluid for the operation mode shown in FIG. 1A.

Inlet valve 122 is upstream of dynamic receiver 120, and outlet valve 124 is downstream of dynamic receiver 120 with respect to the direction of flow of working fluid through HVACR system 100. Inlet valve 122 is a controllable valve having an open position allowing working fluid to pass therethrough and a closed position prohibiting flow therethrough. When in the open position, inlet valve 122 allows working fluid from upstream of the expander 118 to pass to the dynamic receiver 120, where the working fluid can be retained, thereby reducing the charge of working fluid circulating through HVACR system 100. Outlet valve 124 is a controllable valve having an open position allowing working fluid to pass therethrough and a closed position prohibiting flow therethrough. When in the open position, outlet valve 124 allows working fluid to pass from the dynamic receiver 120 into the flow of working fluid downstream of expander 118, rejoining the working fluid being circulated through HVACR system 100.

Compressor discharge injection line 126 runs from the discharge of the one or more compressors 102 directly to the dynamic receiver 120, with a compressor discharge injection valve 128 disposed along the compressor discharge injection line 126. Compressor discharge injection line 126 provides direct fluid communication between the discharge of the one or more compressors and the dynamic receiver 120, such that compressor discharge can be directed to dynamic receiver 120 without passing through four-way valve 104 or any of the further downstream components of the HVACR system 100 such as first heat exchanger 106, second heat exchanger 110, and the like. Compressor discharge injection valve 128 is a controllable valve having at least an open position permitting flow therethrough and a closed position prohibiting flow. When compressor discharge injection valve 128 is open, some of the discharge from the one or more compressors 102 can pass into dynamic receiver 120. The discharge from the one or more compressors 102 is the working fluid in the form of a relatively hot gas, which can displace a relatively larger mass of liquid working fluid stored in dynamic receiver 120 to facilitate removal of working fluid from the dynamic receiver 120. Working fluid displaced from the dynamic receiver 120 by compressor discharge can pass through outlet valve 124 to join the flow of working fluid downstream of expander 118.

Figure 1B:
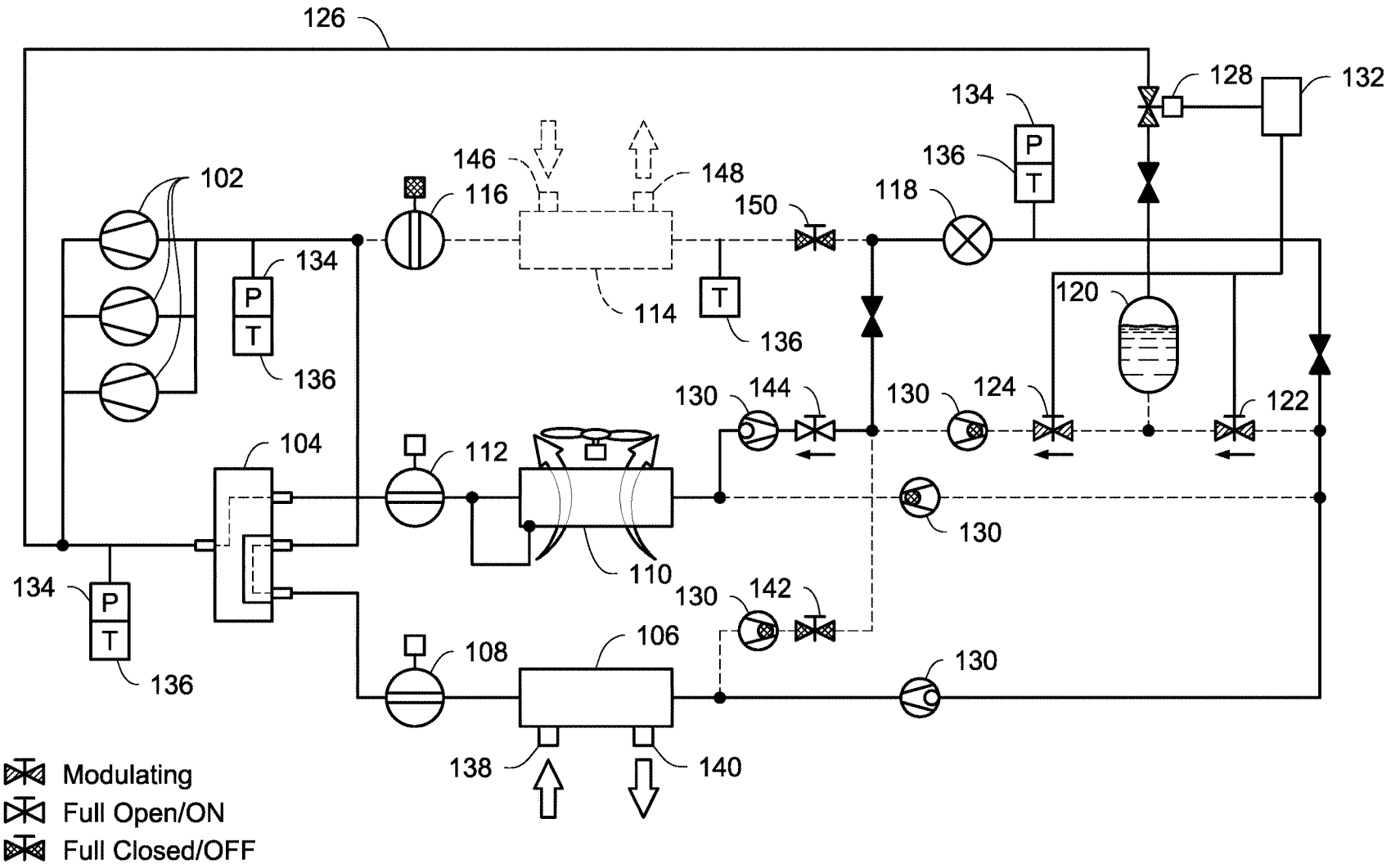
FIG. 1B shows the HVACR system of FIG. 1A when operating in a heating mode.
Figure 1C:
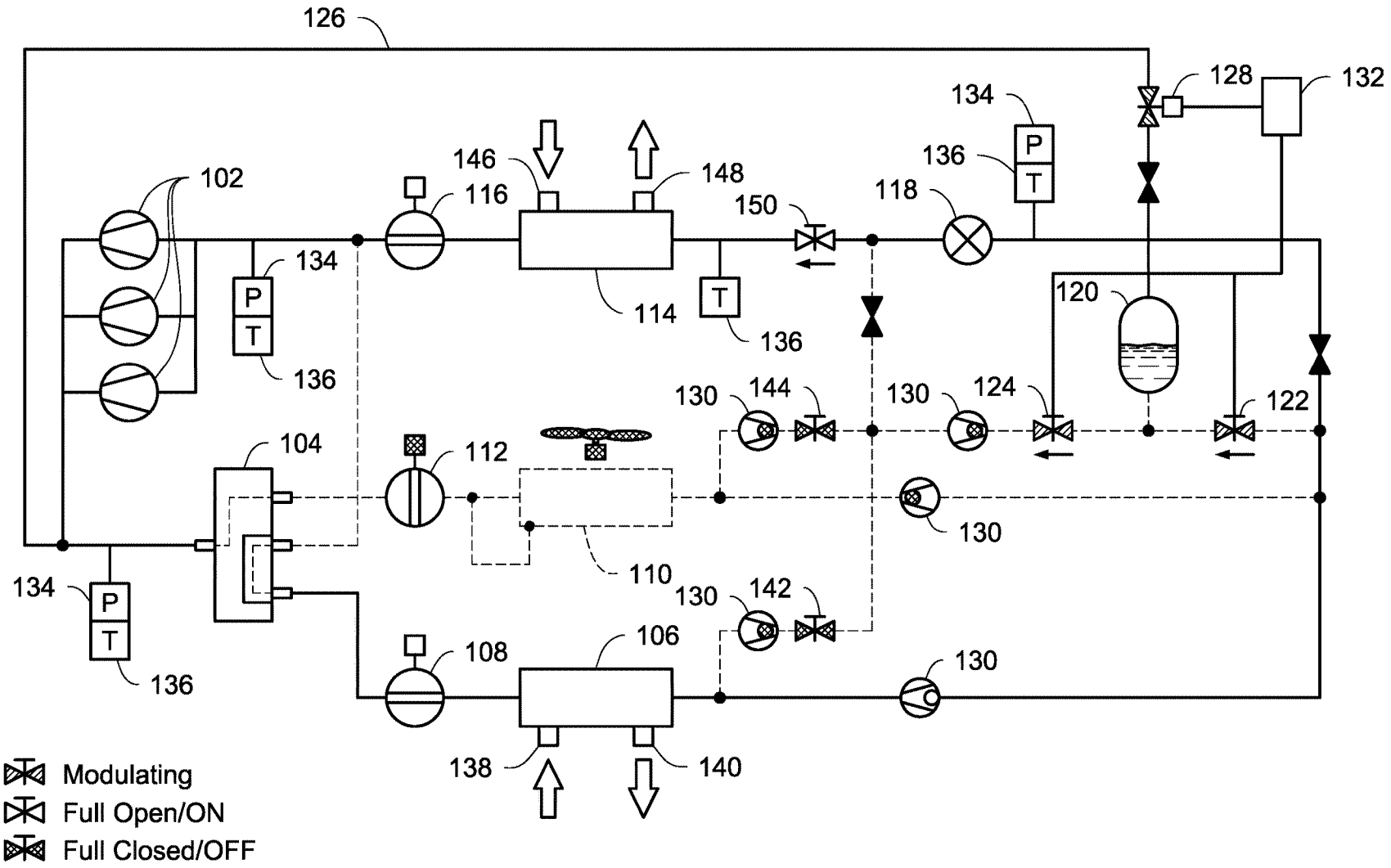
FIG. 1C shows the HVACR system of FIG. 1A when operating in a combined mode providing both heating and cooling.

Check valves 130 can be positioned along various fluid lines in HVACR system 100 as shown in FIGS. 1A-1C. Check valves 130 can be passive one-way valves allowing flow through a fluid line in only one direction to facilitate operation in various modes, with their respective responses to the flows present in different operating modes shown in FIGS. 1A-1C. The check valves 130 can be placed, for example between first heat exchanger 106 and second heat exchanger 110 or third heat exchanger 114, between outlet valve 124 and the remainder of HVACR system 100.

A controller 132 controls at least the inlet valve 122, outlet valve 124, and compressor discharge injection valve 128 to control the amount of working fluid circulating in HVACR system 100 and the amount of working fluid stored in dynamic receiver 120. Controller 132 can control the amount of working fluid stored in dynamic receiver 120 to achieve a target amount or to be within a defined range for the amount of working fluid stored in dynamic receiver 120. Controller 132 is operatively connected to the inlet valve 122, outlet valve 124, and compressor discharge injection valve 128 such that commands can be sent from controller 132 to those valves. The operative connection can be, for example, a direct wired connection or wireless communications. Controller 132 can be configured to open the inlet valve 122 when working fluid is to be added to the dynamic receiver 120. Controller 132 can be configured to open the compressor discharge injection valve 128 and the outlet valve 124 when working fluid is to be removed from the dynamic receiver 120. Controller 132 can be further configured to close the inlet valve 122 when working fluid is being retained in or removed from dynamic receiver 120. Controller 132 can be further configured to close compressor discharge injection valve 128 and outlet valve 124 when working fluid is retained in or added to dynamic receiver 120.

Controller 132 can further be configured to determine the target amount or the defined range for the amount of working fluid stored in the dynamic receiver 120. In an embodiment, the target amount or defined range can be determined based on a current operating mode for the HVACR system 100, such as the cooling mode shown in FIG. 1A, the heating mode shown in FIG. 1B, or the heating and cooling mode shown in FIG. 1C. In an embodiment, the target amount or defined range can be determined based on operating conditions for the HVACR system 100, such as a position on an operating map for the HVACR system 100. In an embodiment, the target amount or defined range can be based on a subcooling value for the HVACR system 100, such as the subcooling value when compared to a subcooling threshold value. The subcooling threshold value can in turn be associated with particular operating modes or operating conditions. In an embodiment, there is a fixed subcooling threshold set for each operating mode. In an embodiment, the subcooling threshold can be adapted to either optimize efficiency, or to allow a larger operating envelope for the HVACR system 100, for example by providing a range or otherwise allowing some measure of deviation from the subcooling threshold. Controller 132 can further be configured to control levels of fluid in dynamic receiver 120 not only in particular operating modes, but during transitions between operating modes, such as transition from heating only to heating and cooling, heating only to cooling only, cooling only to heating only, and the like.

Pressure sensors 134 and/or temperature sensors 136 can be included to measure the pressure and temperature of the working fluid at one or more locations within HVACR system 100. Pressure sensors 134 can be any suitable pressure sensors for measuring the pressure of the working fluid at a point within HVACR system 100. Temperature sensors 136 can be any suitable temperature sensors for measuring the temperature of the working fluid at a point within HVACR system 100. In an embodiment, pressure sensors 134 and/or temperature sensors 136 can be configured to provide the pressure and/or temperature measurements to controller 132, for example by a wired connection or wireless communications. In an embodiment, at least one pressure sensor 134 and at least one temperature sensor 136 can be included along a liquid line of HVACR system 100 between either first heat exchanger 106 or second heat exchanger 110, depending on which is serving as a condenser in the current operating mode, and the expander 118. In an embodiment, the pressure sensor 134 and the temperature sensor 136 provided along the liquid line can be positioned just upstream from the expander 118 with respect to a direction of flow of the working fluid. In an embodiment, at least one pressure sensor 134 and/or temperature sensor 136 can be provided at the suction of the one or more compressors 102. In an embodiment, at least one pressure sensor 134 and/or temperature sensor 136 can be provided at the discharge of the one or more compressors 102. Pressure sensors 134 and/or temperature sensors 136 can be further provided at other points of interest along the HVACR system 100, for example providing a temperature sensor just upstream of the third heat exchanger 114 with respect to the direction of flow of the working fluid through HVACR system 100.

In the embodiment shown in FIG. 1A, where the HVACR system 100 is functioning as a chiller, the four-way valve 104 directs discharge from the one or more compressors 102 to second heat exchanger 110 and provides a pathway from third heat exchanger 114 back to the suction of the one or more compressors 102. The four-way valve also provides a pathway for fluid communication between the first heat exchanger 106 and the suction of the one or more compressors 102, however in FIG. 1A, the pathway is closed from the first heat exchanger 106, due to first heat exchanger isolation valve 108 being in a closed position.

FIG. 1B shows the HVACR system 100 of FIG. 1A when it is being operated in a heating mode. In the heating mode shown in FIG. 1B, four-way valve 104 is in a position where the discharge of the one or more compressors 102 is directed to the first heat exchanger 106, and where second heat exchanger 110 is in communication with the suction of the one or more compressors 102. The cooling valve 150 and the third heat exchanger isolation valve 116 are in the closed position, preventing flow of the working fluid to third heat exchanger 114. In this embodiment, the working fluid discharged by the one or more compressors 102 passes to first heat exchanger 106, where the working fluid rejects heat, and the heating process fluid accepts that heat. The working fluid then continues to expander 118, and, when inlet valve 122 is open based on a command from controller 132, some of the working fluid can pass to the dynamic receiver 120 through inlet valve 122 prior to reaching expander 118. The working fluid expanded by expander 118 and any working fluid leaving the dynamic receiver 120 by way of outlet valve 124 when outlet valve 124 is opened then pass to second heat exchanger 110 through the heat pump valve 144, which is in the open position. At second heat exchanger 110, the working fluid absorbs heat from ambient air, and then is directed by four-way valve to the suction of the one or more compressors 102. Thus, in the heating mode shown in FIG. 1B, the HVACR rejects heat to the heating process fluid at first heat exchanger 106 and absorbs heat from the ambient environment at second heat exchanger 110, functioning as a heat pump to heat the heating process fluid.

In the heating mode shown in FIG. 1B, the amount of working fluid stored in dynamic receiver 120 can be relatively greater than the amount stored in dynamic receiver 120 during the cooling mode shown in FIG. 1A, meaning a smaller volume of working fluid is circulating through HVACR system 100. However, it is understood that the quantities of working fluid in dynamic receiver 120 and circulating through the remainder of HVACR system 100 can be determined particularly based on specific operating conditions and other factors as described herein.

FIG. 1C shows the HVACR system 100 of FIG. 1A when operating in a combined mode providing both heating and cooling. In the heating and cooling mode shown in FIG. 1C, four-way valve 104 is in a position where the discharge of the one or more compressors 102 is directed to the first heat exchanger 106. Second heat exchanger isolation valve 112 and heat pump valve 144 are in the closed position, preventing flow of the working fluid to second heat exchanger 110. Four-way valve 104 further provides communication between the third heat exchanger 114 and the suction of the one or more compressors 102. In this embodiment, the working fluid discharged by the one or more compressors 102 passes to first heat exchanger 106, where the working fluid rejects heat, and the heating process fluid accepts that heat. The working fluid then continues to expander 118, and, when inlet valve 122 is open based on a command from controller 132, some of the working fluid can pass to the dynamic receiver 120 through inlet valve 122 prior to reaching expander 118. The working fluid expanded by expander 118 any working fluid leaving the dynamic receiver 120 by way of outlet valve 124 then pass to third heat exchanger 114 through the cooling valve 150, which is in the open position. At third heat exchanger 114, the working fluid absorbs heat from the cooling process fluid, and then passes to the suction of the one or more compressors 102. Thus, in the heating and cooling mode shown in FIG. 1C, the HVACR rejects heat to the heating process fluid at first heat exchanger 106 and absorbs heat from the cooling process fluid at third heat exchanger 114, cooling the cooling process fluid while also heating the heating process fluid.

In the heating and cooling mode shown in FIG. 1C, the amount of working fluid stored in dynamic receiver 120 can be relatively greater than the amount stored in dynamic receiver 120 during the cooling mode shown in FIG. 1A and relatively less than the amount stored in dynamic receiver 120 during the heating mode shown in FIG. 1B, meaning an intermediate volume of working fluid is circulating through HVACR system 100 in this mode. However, it is understood that the quantities of working fluid in dynamic receiver 120 and circulating through the remainder of HVACR system 100 can be determined particularly based on specific operating conditions and other factors as described herein.

While FIGS. 1A-1C show an HVACR system including three heat exchangers and piping to select among them to meet different heating and/or cooling needs including simultaneous heating and cooling, it is understood that embodiments can include other HVACR system designs such as air conditioners, ordinary heat pump systems, or the like. An example of an air conditioner or chiller according to an embodiment could include, for example, only the active elements of the HVACR system 100 when in the cooling mode shown in FIG. 1A. An example of a heat pump could include, for example, only the active elements of HVACR system 100 when in the heating mode shown in FIG. 1C. These embodiments will continue to include the dynamic receiver 120, inlet valve 122, and outlet valve 124 in parallel with an expander such as expander 118, and further include compressor discharge injection line 126. HVACR systems according to embodiments can include any two heat exchangers, such as two of the first, second, and third heat exchangers 106, 110, and 114, with one of those heat exchangers operating as a condenser and the other as an evaporator. While the HVACR system 100 shown in FIGS. 1A-1C includes first, second, and third heat exchangers 106, 110, and 114, any one or more can be excluded depending on the particular system, for example in systems that are strictly providing heating or cooling, or that are standard reversible heat pumps.

In addition to the modes shown in FIGS. 1A-1C, the various valves including the first, second, and third heat exchanger isolation valves 108, 112, and 116, cooling valve 150, heat pump valve 144, and defrost valve 142, and four-way valve 104 can be positioned in combination with one another to achieve other operation modes for the HVACR system 100, such as purging, defrosting, or recovering lubricant. The check valves 130 respond to the direction of flow provided through control of those other valves to achieve the particular desired operation of the HVACR system 100. Examples of other modes that can be included include defrost modes or any other suitable type of operation for the particular HVACR system 100. The control of dynamic receiver 120 in such modes can be to provide at or near a minimum working fluid charge within HVACR system 100 for the particular operating mode.

Figure 2:
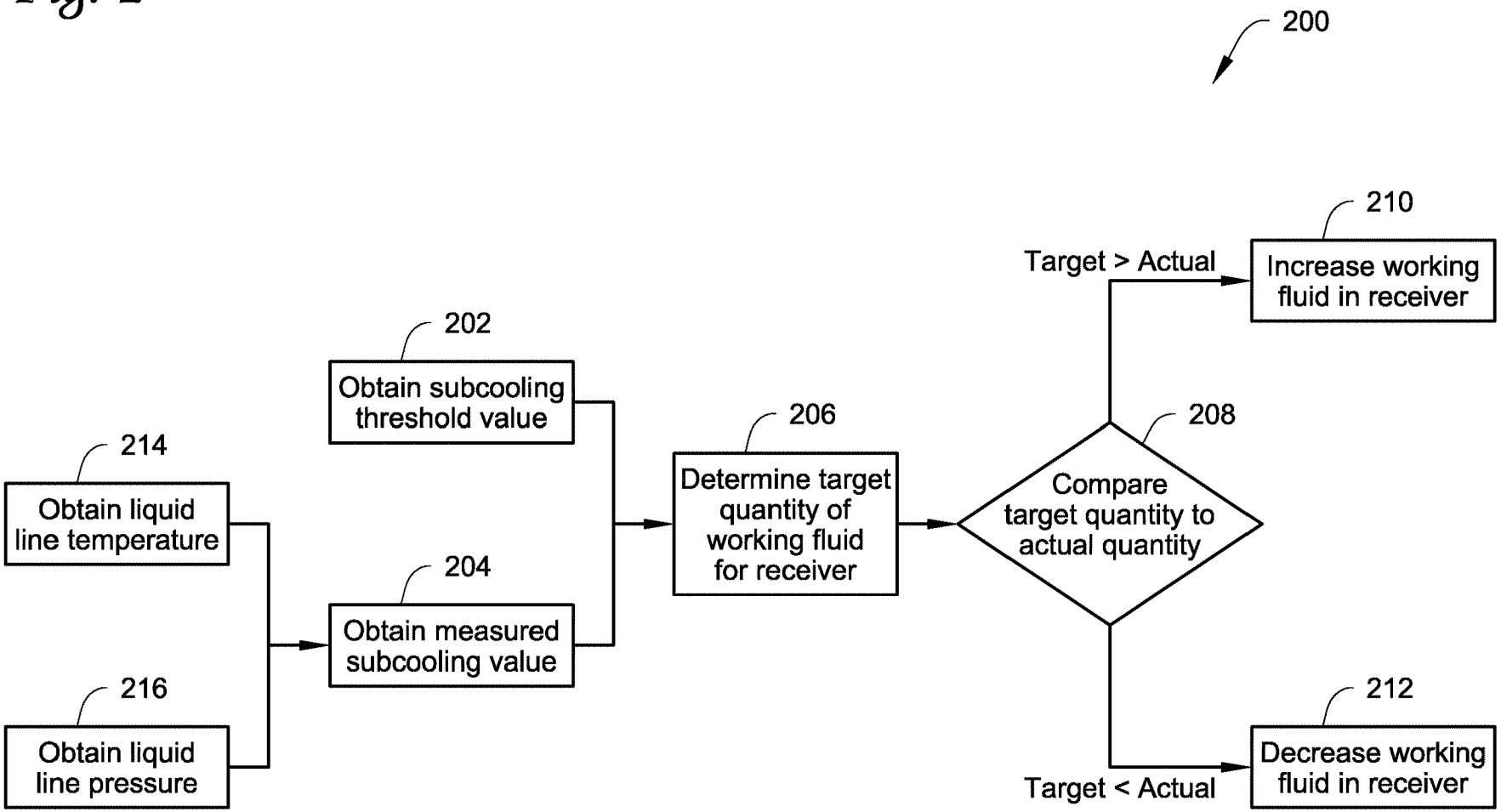
FIG. 2 shows a flowchart of logic for controlling a dynamic receiver according to an embodiment.

FIG. 2 shows a flowchart of logic for controlling a dynamic receiver of a heating, ventilation, air conditioning and refrigeration (HVACR) system according to an embodiment. Method 200 includes obtaining a subcooling threshold value 202, obtaining a measured subcooling value ???204, determining a target quantity of working fluid 206, comparing the target quantity of working fluid to an actual quantity of working fluid in the receiver 208, and based on the comparison, performing one of adding working fluid to the receiver 210 or removing working fluid from the receiver 212. Optionally, obtaining the measured subcooling at 204 can include obtaining a liquid line temperature 214 and/or obtaining a liquid line pressure 216.

A subcooling threshold value is obtained at 202. The subcooling threshold value can be a specific subcooling value or range of subcooling values associated with a particular operating mode, such as the heating, cooling, or heating and cooling modes shown in FIGS. 1A-1C, or for particular operating conditions such or other operational parameters. The subcooling threshold value can in turn be associated with particular operating modes or operating conditions. In an embodiment, there is a fixed subcooling threshold value set for each operating mode. In an embodiment, the subcooling threshold value can be adapted to either optimize efficiency, or to allow a larger operating envelope for the HVACR system 100, for example by providing a range or otherwise allowing some measure of deviation from the subcooling threshold value.

A measured subcooling may be obtained at 204. Optionally, obtaining the measured subcooling at 204 can include obtaining a liquid line temperature 214 and/or obtaining a liquid line pressure 216. In an embodiment, the measured subcooling is a value representative of the subcooling currently occurring in the HVACR system. The measured subcooling can be calculated from a temperature in a liquid line of the HVACR system obtained at 214 and/or a pressure in the liquid line obtained at 216. The measured subcooling can be obtained, for example, as a difference between a saturated liquid temperature and the liquid line temperature. In an embodiment, the saturated liquid temperature can be determined based on the pressure in the liquid line obtained at 216. Optionally, a smoothing function can be used when obtaining the measured subcooling at 204. Obtaining the liquid line temperature 214 can include measuring the temperature in a liquid line conveying working fluid from a heat exchanger serving as a condenser to an expander. The liquid line temperature can be obtained at 214 through measuring the temperature using a temperature sensor provided along the liquid line, for example directly upstream of the expander. Obtaining the liquid line pressure at 216 can include measuring the pressure in the liquid line, for example through a pressure sensor provided along the liquid line, such as one directly upstream of the expander. In an embodiment, the temperature sensor used at 214 and the pressure sensor used at 216 can be located at approximately the same position along the liquid line.

A target quantity of working fluid is determined at 206. The target quantity of working fluid can be based on a difference between the measured subcooling and the subcooling threshold value. In an embodiment, the target quantity can further be based on a $K_P$ value for the HVACR system, where $K_P$ is a gain adjustment factor. $K_P$ can be used at least in part to match the HVACR system dynamics to control actions, to account for the reactive nature of operating the valves controlling flow into or out of the dynamic receiver. In an embodiment, the target quantity can be based directly on the current operating mode of the HVACR system, such as heating, cooling, heating and cooling, purge, defrost, or other possible operating modes of the HVACR system, which can each have a charge quantity associated with that operating mode.

The target quantity of working fluid is compared to an actual quantity of working fluid in the receiver at 208. Based on the comparison, the method 200 can proceed to either adding working fluid to the receiver 210 when the actual quantity of working fluid in the receiver is less than the target quantity, or removing working fluid from the receiver 212 when the actual quantity of working fluid in the receiver exceeds the target quantity.

Working fluid can be added to the receiver at 210. Adding working fluid to the receiver 210 can include opening an inlet valve. Adding working fluid to the receiver 210 can further include ensuring that an outlet valve of the receiver and a compressor discharge injection valve are both closed. Some working fluid passing through the fluid circuit of the HVACR system passes through the inlet valve into the receiver, where it can be stored. The fluid line connecting to the receiver to introduce working fluid into the receiver can be upstream of an expander of the HVACR system with respect to a direction of working fluid flow through the HVACR system. Adding working fluid from the receiver 210 can be performed for as long as the amount of working fluid is below a target amount of working fluid determined at 206, based on the comparison performed at 208.

Working fluid can be removed from the receiver at 212. The working fluid can be removed from the receiver 212 by opening an outlet valve of the receiver and opening a compressor discharge injection valve. Removing working fluid from the receiver 212 can further include ensuring an inlet valve for the receiver is closed. Compressor discharge fluid introduced by the compressor discharge injection valve is a hot gas, and introduction of the compressor discharge fluid can drive out a relatively larger quantity of the stored working fluid in the receiver, which leaves the receiver by way of the outlet valve. The working fluid removed from the receiver is introduced to the HVACR system downstream of an expander of the HVACR system, relative to the direction of flow of working fluid through the HVACR system. The working fluid can continue to be removed from the receiver at 212 so long as the quantity of working fluid remains greater than the target quantity of working fluid, as determined by the comparison at 208.

Aspects:

It is understood that any of aspects 1-10 can be combined with any of aspects 11-14.

Aspect 1. A heating, ventilation, air conditioning, and refrigeration (HVACR) system, comprising:

a compressor;

a first heat exchanger;

an expander;

a second heat exchanger;

a dynamic receiver, the dynamic receiver in parallel with the expander with respect to the fluid circuit; and a fluid line configured to convey discharge from the compressor to the dynamic receiver.

Aspect 2. The HVACR system according to aspect 1, further comprising a four-way valve.

Aspect 3. The HVACR system according to aspect 2, further comprising a third heat exchanger, and wherein the first heat exchanger is configured to exchange heat between a working fluid in the fluid circuit and a first process fluid, the second heat exchanger is configured to exchange heat between the working fluid and a second process fluid, and the third heat exchanger is configured to exchange heat with ambient air.

Aspect 4. The HVACR system according to any of aspects 1-3, further comprising a controller configured to operate an inlet valve positioned directly upstream of the dynamic receiver, an outlet valve positioned directly downstream of the dynamic receiver, and a compressor discharge injection valve positioned along the fluid line to regulate a quantity of a working fluid stored in the dynamic receiver.

Aspect 5. The HVACR system according to aspect 4, wherein the controller is configured to determine a target quantity of working fluid to be stored in the dynamic receiver based on a measured liquid line subcooling value and a subcooling threshold value.

Aspect 6. The HVACR system according to aspect 5, wherein the measured liquid line subcooling value is based on a liquid line temperature measurement and a liquid line pressure measurement.

Aspect 7. The HVACR system according to any of aspects 5-6, wherein the target quantity of working fluid is further based on a $K_P$ value.

Aspect 8. The HVACR system according to any of aspects 5-7, wherein the controller is configured to reduce the quantity of working fluid stored in the dynamic receiver by opening the outlet valve and the compressor discharge injection valve until the target quantity of working fluid is stored in the dynamic receiver.

Aspect 9. The HVACR system according to any of aspects 5-8, wherein the controller is configured to increase the quantity of working fluid stored in the dynamic receiver by opening the inlet valve until a target quantity of working fluid is stored in the dynamic receiver.

Aspect 10. The HVACR system according to any of aspects 5-9, wherein the subcooling threshold value is based on an operating mode of the HVACR system.

Aspect 11. A method of controlling a heating, ventilation, air conditioning, and refrigeration (HVACR) system, comprising:

determining, using a controller, a target quantity of working fluid to be stored in a dynamic receiver included in the HVACR system, the target quantity based on a subcooling threshold value and a measured subcooling value;

comparing a quantity of working fluid in the dynamic receiver to the target quantity;

when the quantity of working fluid in the dynamic receiver exceeds the target quantity, removing working fluid from the dynamic receiver by opening an outlet valve directly downstream of the dynamic receiver and opening a compressor discharge injection valve disposed along a fluid line connecting the discharge of a compressor of the HVACR system to the dynamic receiver.

when the quantity of working fluid in the dynamic receiver is less than the target quantity, adding working fluid to the dynamic receiver by opening an inlet valve directly upstream of the dynamic receiver with respect to the working fluid flow path in the HVACR system, wherein the dynamic receiver is in parallel with an expander included in the HVACR system.

Aspect 12. The method according to aspect 11, wherein the measured liquid line subcooling value is based on a liquid line temperature measurement and a liquid line pressure measurement.

Aspect 13. The method according to any of aspects 11-12, wherein the target quantity of working fluid is further based on a $K_P$ value.

Aspect 14. The method according to any of aspects 11-13, wherein the subcooling threshold value is based on an operating mode of the HVACR system.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating, ventilation, air conditioning, and refrigeration (HVACR) system, comprising a fluid circuit including:

a compressor;

a first heat exchanger;

an expander;

a second heat exchanger;

a dynamic receiver, the dynamic receiver in parallel with the expander with respect to the fluid circuit;

an inlet valve positioned directly upstream of the dynamic receiver, the inlet valve downstream of the first heat exchanger and upstream of the second heat exchanger with respect to the fluid circuit; and an outlet valve positioned directly downstream of the dynamic receiver, the outlet valve downstream of the first heat exchanger and upstream of the second heat exchanger with respect to the fluid circuit; and a controller configured to control the inlet valve and the outlet valve, wherein the controller is configured to determine a target quantity of working fluid to be stored in the dynamic receiver based on a measured liquid line subcooling value and a subcooling threshold value, and when a quantity of working fluid stored in the dynamic receiver exceeds the target quantity, the controller is configured to reduce the quantity of working fluid stored in the dynamic receiver by opening the outlet valve until the target quantity of working fluid is stored in the dynamic receiver.

2. The HVACR system of claim 1, further comprising a four-way valve.

3. The HVACR system of claim 2, further comprising a third heat exchanger, and wherein the first heat exchanger is configured to exchange heat between a working fluid in the fluid circuit and a first process fluid, the second heat exchanger is configured to exchange heat between the working fluid and a second process fluid, and the third heat exchanger is configured to exchange heat with ambient air.

4. The HVACR system of claim 1, wherein the measured liquid line subcooling value is based on a liquid line temperature measurement and a liquid line pressure measurement.

5. The HVACR system of claim 1, wherein the target quantity of working fluid is further based on a $K_P$ value.

6. The HVACR system of claim 1, wherein the controller is configured to increase the quantity of working fluid stored in the dynamic receiver by opening the inlet valve until the target quantity of working fluid is stored in the dynamic receiver.

7. The HVACR system of claim 1, wherein the subcooling threshold value is based on an operating mode of the HVACR system.

8. A method of controlling a heating, ventilation, air conditioning, and refrigeration (HVACR) system, comprising:

determining, using a controller, a target quantity of working fluid to be stored in a dynamic receiver included in the HVACR system, the target quantity based on a subcooling threshold value and a measured subcooling value;

comparing a quantity of working fluid in the dynamic receiver to the target quantity;

when the quantity of working fluid in the dynamic receiver exceeds the target quantity;

removing working fluid from the dynamic receiver by opening an outlet valve directly downstream of the dynamic receiver, and when the quantity of working fluid in the dynamic receiver is less than the target quantity, adding working fluid to the dynamic receiver by opening an inlet valve downstream of a first heat exchanger and upstream of a second heat exchanger with respect to the working fluid flow path in the HVACR system, wherein the dynamic receiver is in parallel with an expander included in the HVACR system, the inlet valve is located downstream of a first heat exchanger of the HVACR system and upstream of a second heat exchanger of the HVACR system, and the outlet valve is located downstream of the first heat exchanger of the HVACR system and upstream of the second heat exchanger of the HVACR system.

9. The method of claim 8, wherein the measured subcooling value is based on a liquid line temperature measurement and a liquid line pressure measurement.

10. The method of claim 8, wherein the target quantity of working fluid is further based on a $K_P$ value.

11. The method of claim 8, wherein the subcooling threshold value is based on an operating mode of the HVACR system.

* * * * *